US008919758B2

(12) United States Patent
Mueller

(10) Patent No.: US 8,919,758 B2
(45) Date of Patent: Dec. 30, 2014

(54) METHOD AND DEVICE FOR REMOVING AT LEAST ONE BOOK BLOCK FROM AND/OR SUPPLYING AT LEAST ONE BOOK BLOCK TO A CONVEYING SECTION OF A BOOK PRODUCTION LINE

(75) Inventor: Hans Mueller, Lauda-Koenigshofen (DE)

(73) Assignee: Mueller Martini Holding AG, Hergiswil (CH)

( * ) Notice: Subject to any disclaimer, the term of this patent is extended or adjusted under 35 U.S.C. 154(b) by 372 days.

(21) Appl. No.: 13/440,721

(22) Filed: Apr. 5, 2012

(65) Prior Publication Data

US 2012/0257946 A1 Oct. 11, 2012

Related U.S. Application Data

(60) Provisional application No. 61/505,234, filed on Aug. 2, 2011.

(30) Foreign Application Priority Data

Apr. 7, 2011 (CH) ..... 0638/11

(51) Int. Cl.
*B42C 11/04* (2006.01)
*B42C 19/08* (2006.01)

(52) U.S. Cl.
CPC ..... *B42C 11/04* (2013.01); *B65H 2301/437* (2013.01); *B65H 2511/512* (2013.01); *B42C 19/08* (2013.01); *B65H 2511/25* (2013.01)
USPC ..... 270/52.02; 270/52.04

(58) Field of Classification Search
CPC ..... B42C 11/04; B42C 19/00; B42C 19/08; B65H 2511/512; B65H 2511/25; B65H 29/62; B65H 2301/437
USPC ..... 270/52.02, 52.03, 52.04; 412/4, 19
See application file for complete search history.

(56) References Cited

U.S. PATENT DOCUMENTS 5,295,775 A * 3/1994 Andjelic et al. ..... 412/2
6,206,358 B1 * 3/2001 Yamaguchi et al. ..... 270/52.02

(Continued)

FOREIGN PATENT DOCUMENTS

CH 00759/10 A 10/1917
DE 197 29 529 A1 3/1998
DE 102008034065 A1 2/2010

OTHER PUBLICATIONS

International Search Report for related Swiss Patent Application No. 00638/11 dated Jul. 15, 2011.

*Primary Examiner* — Leslie A Nicholson, III
(74) *Attorney, Agent, or Firm* — Venable LLP; Robert Kinberg

(57) ABSTRACT

A method and device for the production of books, including: moving book blocks successively along a conveying section of a book production line; supplying a stack of book cases to the book production line; identifying a marking on each of the book blocks and the book cases; transmitting an identified marking on at least one book case to a machine control of the book production line; assigning a dataset stored in the machine control for a sequence of book cases to the supplied stack; determining a sequence in the machine control for book blocks positioned on the conveying section; comparing the dataset for the sequence of the book cases to the sequence of the book blocks; and removing and/or supplying at least one book block from or to the conveying section if the sequence of the book blocks deviates from the sequence of the book cases using the machine control.

6 Claims, 9 Drawing Sheets

(56) References Cited

U.S. PATENT DOCUMENTS

| | | | | |
|---|---|---|---|---|
| 7,325,375 | B2 * | 2/2008 | Graushar et al. | 53/397 |
| 7,441,762 | B2 * | 10/2008 | Kearns | 270/52.02 |
| 7,475,523 | B2 * | 1/2009 | Graushar et al. | 53/397 |
| 7,758,036 | B2 * | 7/2010 | Levine et al. | 270/58.08 |
| 8,498,730 | B2 * | 7/2013 | Henry | 700/115 |
| 8,517,656 | B2 * | 8/2013 | Hartshorne et al. | 412/11 |
| 8,579,274 | B2 * | 11/2013 | Mueller | 270/52.2 |
| 2008/0031706 | A1 * | 2/2008 | Silberbauer | 412/19 |
| 2011/0280688 | A1 * | 11/2011 | Mueller | 412/4 |
| 2013/0064626 | A1 * | 3/2013 | Buntemeyer et al. | 412/1 |

* cited by examiner

METHOD AND DEVICE FOR REMOVING AT LEAST ONE BOOK BLOCK FROM AND/OR SUPPLYING AT LEAST ONE BOOK BLOCK TO A CONVEYING SECTION OF A BOOK PRODUCTION LINE

CROSS REFERENCE TO RELATED APPLICATION

This application claims the priority of Swiss Patent Application No. 00638/11, filed on Apr. 7, 2011, as well as U.S. Provisional Patent Application No. 61/505,234, filed on Aug. 2, 2011, the subject matter of which is incorporated herein by reference.

BACKGROUND OF THE INVENTION

Conventional book production lines successively join respectively one book block and one book case in a clocked operation. For this, the book blocks and the book cases are normally first produced in separate machines. In book production lines, for example as disclosed in German patent document DE 19729529 A1, the book block initially moves separately from the associated book case through the processing stations, such as the stations for the rounding, backing, spine glue application and head banding. The book case generally moves through a case rounding device before a marriage takes place in the downstream arranged casing-in machine, meaning before the book block and the case are joined together.

Conventional book production lines of this type are used to produce medium to large editions of books. Thus, an equal number of identical book cases are provided for a series of identical book blocks, wherein it is not necessary to observe a specific sequence because one book is composed in the same way as another book within a single edition.

When producing small editions of personalized books, for example books containing photographs, the book block and the book case are unique items. The small edition thus requires an unambiguous identification of the book case and the book block, wherein reference to this is already made in German patent document DE 102008034065 A1.

For a non-problematic processing of small editions in a conventional book production operation, for example referring to a throughput range of 3600 hardcover books per hour, either the book case or the book block must take on a control function. A section of the later book therefore predetermines for the book production line which other section of the later book must be joined to it. Swiss patent document CH 00759/10 deals with the problems of a targeted and flexible incorporation of one of the sections of a book, produced in a small edition, into a book production line and a secure allocation of these sections to be married. The aforementioned document proposes creating task stacks containing book cases of a known composition for which the case information is made available to the book production line in the form of a single marking used for the task stack.

With the known solutions disclosed in the prior art, a machine stop would always be required to supply at least one book block to a conveying section of a book production line, meaning to insert this book block between the successively moved book blocks in a main transporting direction. For that reason, such a method of supplying book blocks has not been used so far.

When operating conventional book production lines of this type, it has nevertheless turned out that it may be necessary in some circumstances to remove or supply individual book cases and/or book blocks. Those circumstance exist, for example, if the book cases and the book blocks must travel different distances along the book production line, for example if 12 book blocks are positioned in the processing stations of the book production line while only 3 book cases are positioned thereon. It is possible that the book blocks which are assigned to the book cases in the book production line are not yet available. Further irregularities are also conceivable, for example that a book block is damaged during previous operating steps or that other types of quality problems are detected. In those cases it may be useful to remove such a book block prior to its marriage with an associated book case. If a single book block is missing from the conveying section, an empty cycle is assigned to this missing book block and the associated book case is transferred out at the appropriate location.

SUMMARY

It is an object to configure the removal of individual book blocks from the conveying section of a conventional book production line, where the removal should, if possible, not interfere with the operating sequence of the book production line. It is furthermore an object to provide a solution with respect to supplying book blocks, previously removed from the conveying section and, if applicable, additional book blocks to the conveying section.

This and the other objects are accomplished according to one aspect of the invention wherein there provided a method for the production of books which, in one embodiment, includes the steps of 1) moving a plurality of book blocks successively along a conveying section of a book production line in a main transporting direction; 2) supplying a stack of book cases to the book production line; 3) identifying a marking on each of the book blocks and the book cases; 4) transmitting an identified marking on at least one book case to a machine control of the book production line; 5) assigning, as a result of the marking on the at least one book case, a dataset stored in the machine control for a sequence of book cases to the supplied stack, where the assigning of the dataset may be done by one of the machine control or an operator; 6) determining, based on the identified markings of the book blocks, a sequence in the machine control for book blocks positioned on the conveying section; 7) comparing the dataset for the sequence of the book cases to the sequence of the book blocks; and 8) at least one of removing or supplying at least one book block from or to the conveying section, based on the comparison, if the sequence of the book blocks deviates from the sequence of the book cases using the machine control.

According to an embodiment, books produced with the book production line are composed of at least one book block and a solid book case that protects the book block. For the marriage of the book block and the book case, the book block and book case may be transported parallel to each other and coming from the same direction, or also coming from different directions.

According to another embodiment, markings may be first identified on the book blocks as well as the book cases. Subsequently, the at least one book block may be removed in dependence on an evaluation made in a machine control of the previous identification.

According to one embodiment, following the supplying of a stack of book cases and a number of book blocks to the book production line, the marking on at least one case in the supplied stack may be identified, wherein this marking may be subsequently transmitted to the machine control. Based on the marking identified on the at least one book case, the machine control may then assign to the supplied stack a dataset, stored in the machine control, which relates to the sequence of the cases in this stack, and/or an operator makes this assignment. Owing to the markings applied to the book blocks that are supplied to the book production line, a sequence may be determined in the machine control for these book blocks in the conveying section and may be compared to the dataset for the sequence of the book cases. As a result of this comparison, the machine control may trigger the removal and/or the supplying of at least one book block if the sequence of the book cases deviates from the sequence of the book blocks.

The method may make it possible to remove from and/or supply to the conveying section at least one book block in a cost-effective manner and without interfering with the operation.

According to one embodiment, the at least one book block may be removed from the conveying section in that the respective book block is deposited onto a first device for the lateral transport and is conveyed thereon in a direction lateral to the main transporting direction, thus realizing a relatively simple, cost-effective solution for removing a book block from the conveying section.

According to a different embodiment of the method, the at least one book block removed from the conveying section may be initially placed temporarily onto the first lateral transport device. The remaining book blocks may then be moved by the conveying section in the main transporting direction until a book block which matches the at least one book block removed from the conveying section, corresponding to the sequence for the book cases, is positioned immediately upstream of the first lateral transport device. Subsequently, a following block which corresponds to the at least one removed book block in the sequence for the book cases is held in place long enough on the conveying section until an empty cycle has been generated in the conveying section, downstream of the following book block. Following this, the at least one book block removed from the conveying section may be again introduced into the conveying section by moving it with the aid of the device in a direction transverse to the main conveying direction and is inserted in place of the empty cycle.

According to an embodiment, if two book blocks are thus simply exchanged in their sequence, the removed book block may be deposited only temporarily on the lateral transport device and, once the following book block has moved past, is again advantageously supplied with the aid of this device to the conveying section of the book production line.

According to a different embodiment of the method, at least one book block may be supplied with the aid of a second lateral transport device to the conveying section for the book blocks at a location upstream of where the at least one book block is removed from the conveying section and downstream of where the markings on the book blocks are identified.

As a result, one or a plurality of book blocks can be inserted even during the running operation, as predetermined by the supplied stack of book cases, which on the whole leads to fewer production interruptions and thus an increased profitability of the book production line.

According to yet another embodiment of the method, a first conveying element which is arranged parallel to the conveying section may convey at least one book block between the first and the second lateral transport device, counter to the main transporting direction, thereby advantageously making possible a full automation.

According to another embodiment, a second conveying element which is arranged parallel to the conveying section may convey at least one book block successively in the main transporting direction as well as counter to this direction.

According to one embodiment, a combination setup with a second conveying element of this type or a plurality of conveying elements which can be connected via extended devices for the lateral transport make possible a gathering and a complex sorting of book blocks removed from a moving series of book blocks.

The application furthermore relates to a device for the production of books, in particular for producing small book editions, which according to one embodiment includes a conveying section that successively moves a plurality of book blocks in a main transporting direction; a first lateral transport device that intervenes in the conveying section and is adapted to at least one of remove or supply at least one book block from or to the conveying section in a direction lateral to the main transporting direction; a first conveying element that is connected to the first lateral transport device and is arranged parallel to the conveying section, where the first conveying element extends counter to the main transporting direction of the conveying section; and a machine control that is connected to both the conveying section and to the first lateral transport device for the lateral transport of the at least one book block.

According to one embodiment, the conveying section may include at least one book block stop mechanism that is connected to the machine control. An empty cycle can thus advantageously be generated on the conveying section and a temporarily transferred-out book block, e.g. because of an incorrect sequence, can again be introduced into the conveying section such that the book block sequence corresponds to the sequence of the book cases.

According to another embodiment, the stop mechanism may include a block barrier for stopping a book block, with an acceleration unit and with a light barrier that is arranged downstream of the acceleration unit. As a result of a combination of block barrier and acceleration unit, a defined spacing can be generated between the book blocks. The spacing can be monitored with the aid of the light barrier, thus making it possible to determine whether an additional book block has moved past a specific location on the conveying section. Of course, the above-described empty cycle can also be generated through the cooperation of the block barrier and the acceleration unit.

According a further embodiment, the conveying section may include at least one conveying unit, where the stop mechanism may be arranged at a downstream end of the at least one conveying unit.

According to one embodiment, the first conveying element may also be connected to the machine control. As a result, a non-driven as well as a driven first conveying element can be used.

According to another embodiment, a second lateral transport device for transporting the at least one book block may be positioned upstream of the first lateral transport device for transporting book blocks, such that it can intervene in the conveying section. This second lateral transport device may be connected to the first conveying element and linked to the machine control.

According to a further embodiment, a second conveying element may be connected to the second lateral transport device and linked to the machine control. The second conveying element may be arranged parallel to the conveying section and, relative to the second lateral transport device, may be arranged opposite the first conveying element. The second conveying element may be configured for the conveying of book blocks in the main transporting direction as well as in the opposite direction.

According to one embodiment, the device may be used in conjunction with a book production line.

BRIEF DESCRIPTION OF THE DRAWINGS

The present invention will be more readily understood from the following detailed description when read in conjunction with the accompanying drawings in which.

The same components are given the same reference numbers in the figures. However, not all figures are provided with all reference numbers.

DETAILED DESCRIPTION

Figure 1:
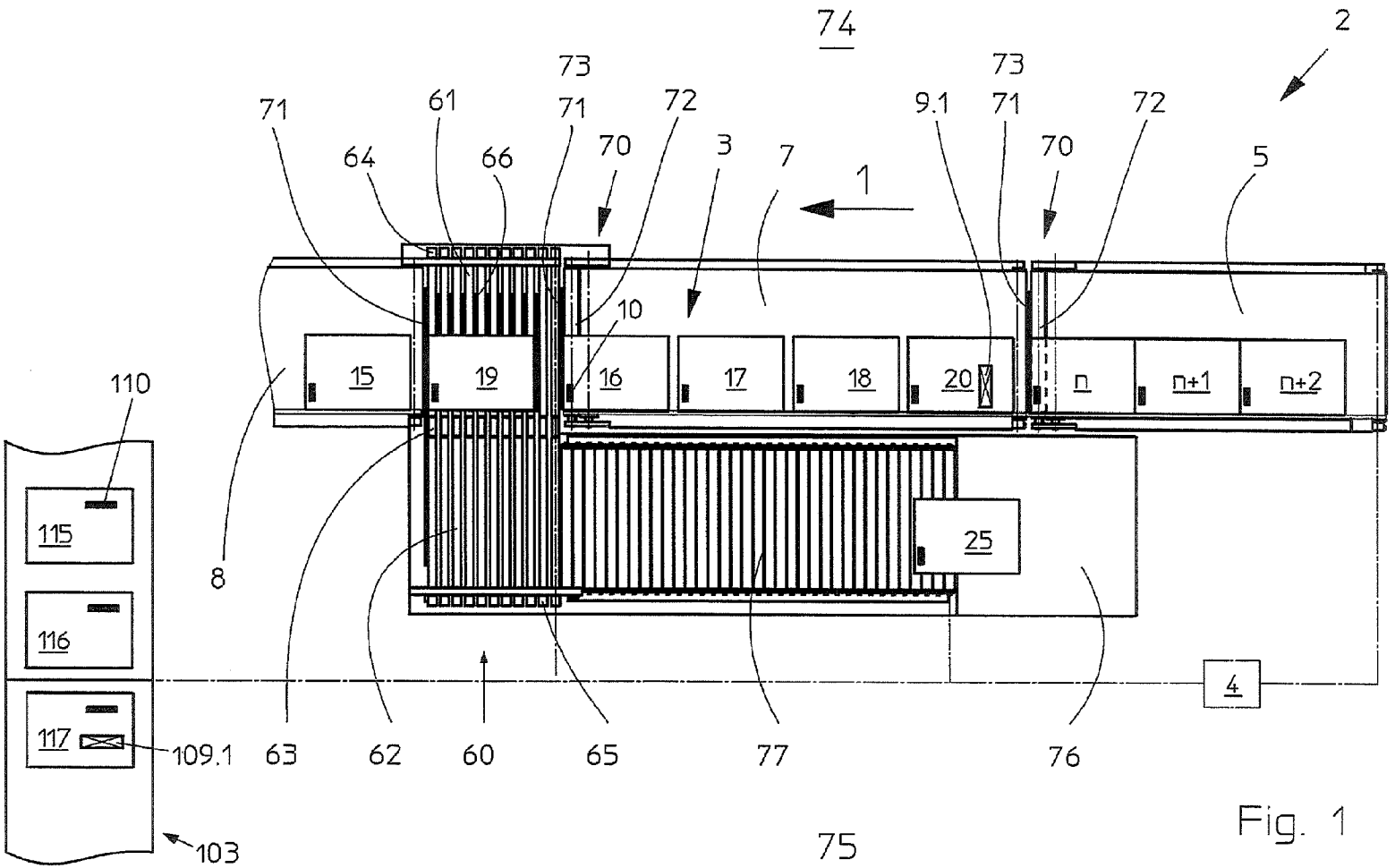
FIG. 1 is a schematic top view of a section of a book production line that contains a book block to be removed, according to a first embodiment of the invention.
Figure 2:
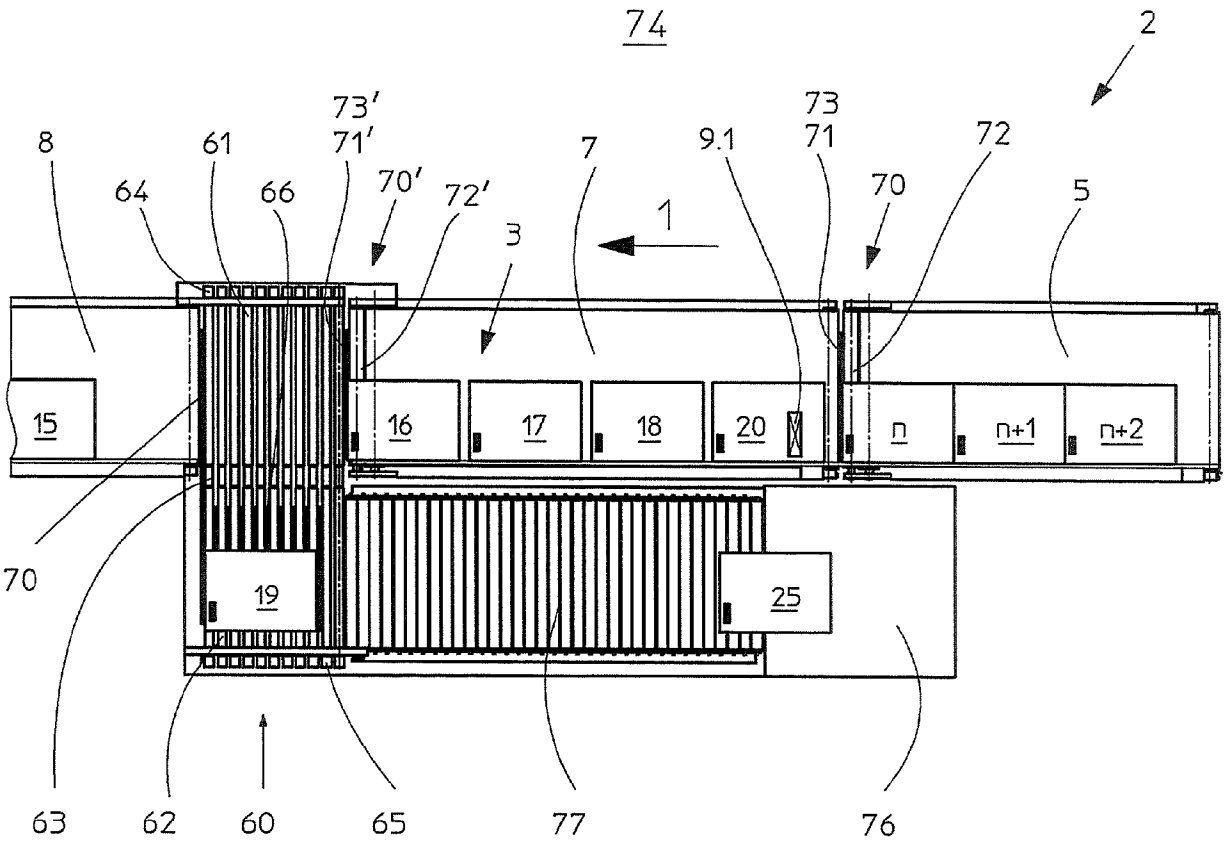
FIG. 2 is a top view, according to FIG. 1, following the removal of the book block.
Figure 3:
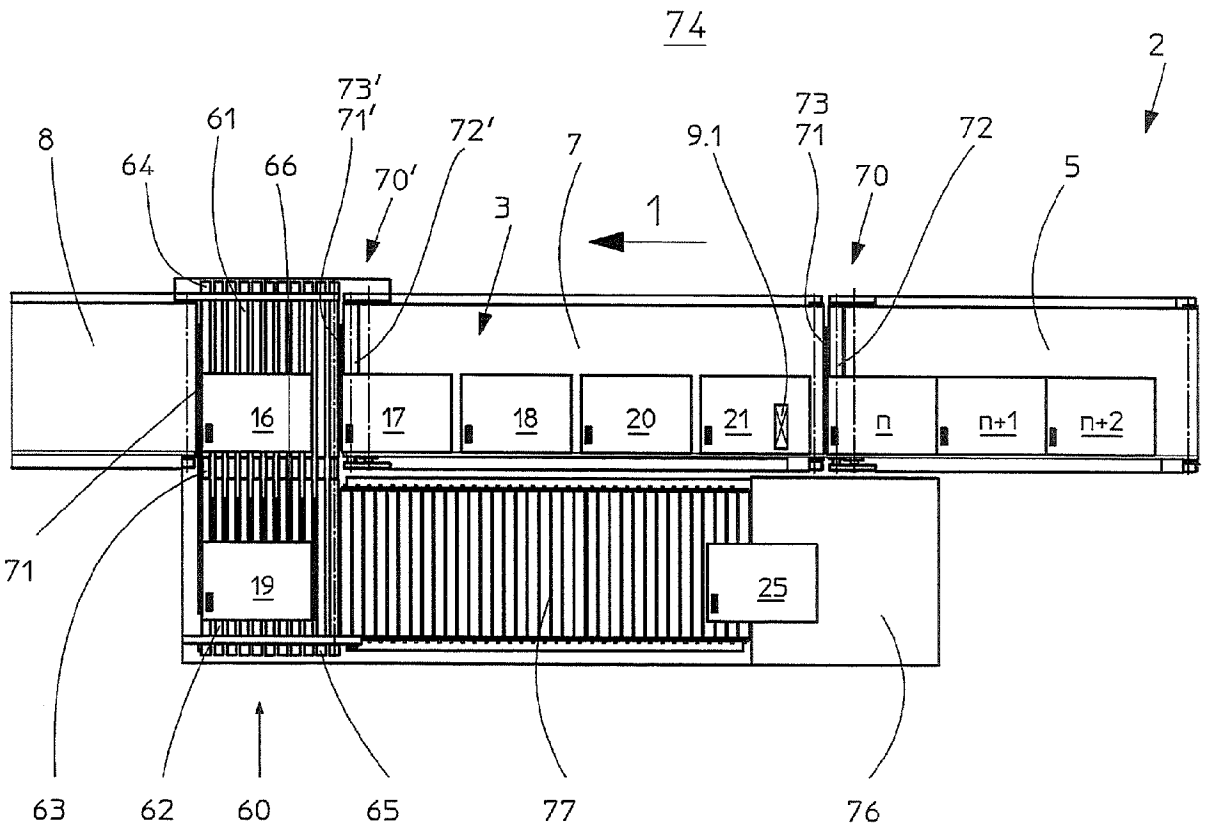
FIG. 3 is a top view, according to FIGS. 1 and 2, following the advancing of the empty cycle in the main transporting direction.

FIGS. 1 to 3 show a section of a book production line 2, including a first embodiment of a device, depicting an operational sequence with three cycles. FIGS. 4 to 9 show a section of a book production line 2, including a second embodiment of a device, following an operational sequence with six cycles.

The device is positioned upstream of a location of marriage taking place on a book production line 2, meaning the joining of book cases and book blocks, and is integrated according to FIGS. 1 to 3 into a conveying section 3 of the book production line 2 for conveying book blocks 15 to 20, n to n+2 which are moving in a main transporting direction 1, and is furthermore connected to a machine control 4 of the book production line 2. For this, the book production line 2 is provided with a first device 60 for the lateral transport of at least one book block 19 which intervenes in the conveying section 3. The conveying section 3 has a frame side 74 and an operating side 75 which are arranged opposite each other.

The conveying section 3 shown in FIGS. 1 to 3 starts with a clocking-in belt 5 as seen in the main transporting direction 1. The clocking-in belt 5 ends with a stop mechanism 70. Besides being used at the location at the end of the clocking-in belt 5, a stop mechanism of this type is also used at different locations which are mentioned in the following description.

The stop mechanism 70 comprises a block barrier 71 of a standard design for stopping a book block n. The stop mechanism 70 furthermore comprises an acceleration unit 72 and a light barrier 73, not shown in further detail herein, which is arranged downstream of the acceleration unit 72. The combination of the block barrier 71 and the acceleration unit 72 ensures that a defined spacing can be generated between the book blocks. A spacing of this type is necessary, for example, to permit monitoring with the aid of a light barrier 73, to determine whether another book block n+1 has moved past a specified location on the conveying section 3.

A first conveying unit 7 that is embodied as intermediate buffer is arranged in the main transporting direction 1 downstream of the clocking-in belt 5. At one end that is facing the clocking-in belt 5, the first conveying unit 7 is provided with a scanner 9.1, for example, a barcode scanner. Facing away from the clocking-in belt 5, the first conveying unit 7 ends in a further stop mechanism 70' at its downstream end.

As seen in the main transporting direction 1, the first lateral transport device 60 adjoins the first conveying unit 7. Devices of this type for the lateral transport are already widely used in prior art arrangements. Following in the main transporting direction 1, a conveying belt 8 is connected to the first lateral transport device 60.

According to one embodiment, the lateral transport device 60, which is aligned coaxial and perpendicular to the main transporting direction 1, is provided with side-by-side arranged rollers 61 on the frame-side and rollers 62 on the operating-side, wherein these are respectively separated by a center bearing 63. The center bearing 63 is a connecting element for the rollers 61, 62 which are attached to a non-depicted frame for the conveying section 3. The frame-side rollers 61 and the operating side rollers 62 can rotate in opposite directions, relative to each other, at the center bearing 63.

At the frame-side ends, the rollers 61 are driven by a frame-side drive 64 and at the operating-side end, the operating-side rollers 62 are driven by an operating-side drive 65.

Arranged below the rollers 61, 62 is a trolley 66 which is provided with upward projecting webs that are aligned parallel to the rollers 61, 62. The webs can be moved upwards between the rollers 61, 62, far enough so that they reach a plane above the rollers 61, 62. The trolley 66 can traverse in a direction transverse to the main transporting direction 1 and parallel to the rollers 61, 62.

Parallel to the conveying section 3 and connected to the first lateral transport device 60 which projects on the operating side, a first conveying element 77 is arranged which extends counter to the main transporting direction 1 and is embodied as gravity roller conveyor according to the first embodiment (FIGS. 1 to 3). Facing away from the first lateral transport device 60, the gravity roller conveyor is inclined slightly until it adjoins a table 76, such that a book block 25 that was previously removed from the conveying section 3 of the book production line 2 and is conveyed on the gravity roller conveyor slides onto the table 76. Alternative to the embodiment as a gravity roller conveyor, the first conveying element 77 can also be driven, of course, for example when embodied as a conveying belt, where it is also connected to the machine control 4 in that case.

During the operation of the device in accordance with the first embodiment shown in FIGS. 1 to 3, at least one book block 19 is removed from the conveying section 3 of the book production line 2. The machine control 4 is connected for this to the conveying section 3 and to the first device 60 for the lateral transport of book blocks. The book block 19 in the process is initially accelerated in the main transporting direction 1, with the aid of the acceleration unit 72' of the stop mechanism 70', before being deposited on the first lateral transport device 60 to be transferred out. Alternative to or simultaneous with the acceleration of the book block 19, a book block 16 which follows this book block on the conveying section 3 can also be stopped.

For example, FIG. 1 shows that the book blocks 20, 18, 17, 16, 19 and 15 are positioned downstream of the scanner 9.1 on the conveying section 3, as seen in the main transporting direction 1. Upstream of the scanner 9.1, the book blocks n, n+1, n+2 are positioned on the clocking-in belt 5, ready for use, wherein these are known to the machine control 4 only after they have moved past the scanner 9.1. Once the book block n passes the scanner 9.1, for example as shown in FIG. 2, it is assigned the number 21 in the sequence of book blocks located in the book production line 3 by the machine control 4 and thus becomes the book block 21 in FIG. 3.

The machine control 4 has identified that four book blocks 16, 17, 18, 20 are positioned on the first conveying unit 7, as shown in FIG. 1. The machine control 4 furthermore has identified that the book block 19 to be removed is located on a first lateral transport device 60. The webs of the trolley 66 are consequently moved up, so that the book block 19 can be transported in a direction lateral to the main transporting direction 1.

In FIG. 2, the book block 19 has already been removed with the aid of the trolley 66 on the operating side 75 from the conveying section 3. Since the sequence of the book blocks on the conveying section 3 is known for the present case up to the book block 20, the removed book block 19 is only parked temporarily, so that it can be inserted once more following the generating of an empty cycle between the book block 18 and the book block 20.

For this, the book blocks 16, 17, 18, 20 which follow in series the transferred-out book block 19 are initially advanced further on the first conveying unit 7 of the conveying section 3 in the main transporting direction 1, until the book block 20 which follows in series the book block 19, previously removed from the conveying section 3, is positioned directly upstream of the first lateral transport device 60, corresponding to the sequence for the book cases. Following this, the book block 20 is stopped with the aid of the block barrier 71' of the stop mechanism 70' until an empty cycle has been generated downstream of the book block 20 on the first lateral transport device 60 which is arranged downstream of the first conveying unit 7. The book block 19, previously removed from the conveying section 3, is then transferred once more into the conveying section 3 by being conveyed with the aid of the device 60 in lateral direction to the main transporting direction 1 and is inserted at the location of the previously generated empty cycle.

According to FIG. 2, the waiting book block 25 is positioned at the location of transition from the first conveying element 77 to the table 76. With this transferred-out book block 25, the trolley 66 was released during a preceding step, following the removal of the book block 25 from the conveying section 3. For this, the rollers 62 on both sides convey the removed book block 25 counter to the main transporting direction 1 onto the first conveying element 77. The book block 25 has rolled down the gravity roller conveyor toward the table 76 and is shown in this position in FIG. 2.

A gap has meanwhile been formed on the conveying section 3, downstream of the first device 60 for the lateral transport, between the book block 15 and the following book block 16. An empty cycle was generated which can be detected as a result of this gap. Since the sequence of the book blocks for the case shown herein is interrupted only by an empty cycle, the book case assigned to the book block 16 is not removed from the book production line 2. Instead, it results only in suppressing a request for supplying a book case. During the following cycle, the book block and the book case will match again.

The Figures do not show an interaction or interplay between the transfer-out of a case and the transfer-out of a block. However, the method provides that the book block removed from the conveying section 3 is not replaced, so that its space remains unoccupied and thus results in preserving the generated gap. If the sequence for the book blocks coincides with the sequence for the book cases, then a request for supplying a book case is suppressed in the event that an empty cycle appears. If a book block in the predetermined sequence is missing, an empty cycle is generated and the associated book case is deposited in an intermediate buffer or storage location (not shown herein), arranged immediately following the case separator, without resulting in a machine stop. The intermediate buffer can be positioned, for example, in the arrangement for supplying the cases, above the first location for a case pusher in a casing-in machine. The book case requires two working cycles to travel from the intermediate buffer to the casing-in position where it is married to the associated book block.

The transferred out book cases are removed at the end of a working order from the intermediate buffer or the intermediate deposit location and are again inserted into a magazine for the cases, in the sequence of their removal. The markings on the transferred out cases are known to the machine control 4 in the sequence in which they were transferred out. The removed book blocks are deposited upstream of the scanner 9.1 on the clocking-in belt 5. Subsequently, these book blocks are scanned in again, are compared and are supplied in the sequence of the book cases for the marriage.

According to one embodiment, a method for the production of book blocks includes producing small book editions. A book may include at least one book block and a book case that protects the book block. As shown in FIG. 1, the method may include moving a plurality of book blocks 15, 19, 16, 17, 18, 20 successively along a conveying section 3 of a book production line 2 in a main transporting direction 1, and supplying a stack of book cases 115, 116, 117, etc. to the book production line 2 via a second conveying section 103. Scanners 9.1 and 109.1 may identify a marking 10, 110, for example, a bar code, on each of the book blocks 15, 19, 16, 17, 18, and the book cases 115, 116, 117, etc. An identified marking 110 on at least one book case 116 may be transmitted to a machine control 4 of the book production line 2. As a result of the marking 110 on the at least one book case 116, a dataset stored in the machine control 4 for a sequence of book cases may be assigned to the supplied stack. The assignment may be conducted by one of the machine control 4 or an operator. Based on the identified markings of the book blocks, a sequence in the machine control is determined for book blocks 15, 19, 16, 17, 18, 20 positioned on the conveying section. The dataset for the sequence of the book cases to the sequence of the book blocks may be compared, and at least one book block 19 may be removed and/or supplied from or to the conveying section 3, based on the comparison, if the sequence of the book blocks deviates from the sequence of the book cases using the machine control 4.

According to an embodiment of the method, the book block 19 may be transferred to a first lateral transport device 60 during removal from the conveying section 3. The book block 19 may be further conveyed on the first lateral transport device 60 in a direction lateral to the main transporting direction 1.

According to one embodiment of the method, the removed book block 19 may be stored temporarily on the first lateral transport device 60. The remaining book blocks 15, 16, 17, 18 may be moved along the conveying section 3 in the main transporting direction 1 until a following book block 20, which corresponds to the book block 19 that is removed from the conveying section 3 and corresponds to the sequence of the book cases, has been positioned directly upstream of the first lateral transport device 60. The following book block 20 may be held in place on the conveying section 3 for a period of time that is long enough so that an empty cycle has been generated on the conveying section 3 creating a gap downstream of the following book block 20. The book block 19 that has been removed from the conveying section 3 may again be inserted into the conveying section 3 by conveying it on the first lateral transport device 60 in a direction lateral to the main transporting direction 1 and into the gap for the empty cycle.

FIGS. 4 to 9 show the second embodiment of the device, wherein the conveying section 3 of the book production line 2 is embodied similar to the conveying section 3 of the first embodiment. The second embodiment shows that a second conveying unit 6, which is also embodied as intermediate buffer, is arranged downstream of the clocking-in belt 5 and upstream of the first conveying unit 7. Deviating from the first embodiment, the conveying section 3 of the second embodiment is interrupted by a second device 50 for the lateral transport, arranged between the two conveying units 6, 7, meaning the second device 50 intervenes in the conveying section 3. As with the first embodiment, the first device 60 for the lateral transport is arranged downstream of the first conveying unit 7.

The second embodiment furthermore differs from the first embodiment by the arrangement of a second scanner 9.2 on the second conveying unit 6, downstream of the stop mechanism 70 of the clocking-in belt 5 as seen in the main transporting direction 1.

A first conveying element 78, for example, a conveying belt and extends counter to the main transporting direction 1 is arranged parallel to the conveying section 3 and the first lateral-transport device 60 that projects on the operating side. The first conveying element 78 extends up to the second lateral-transport device 50 and is connected to it via a stop mechanism 70'''. Facing away from the first conveying element 78, a second conveying element 79 which may also be embodied as conveying belt adjoins the second device 50 for the lateral transport.

Figure 4:
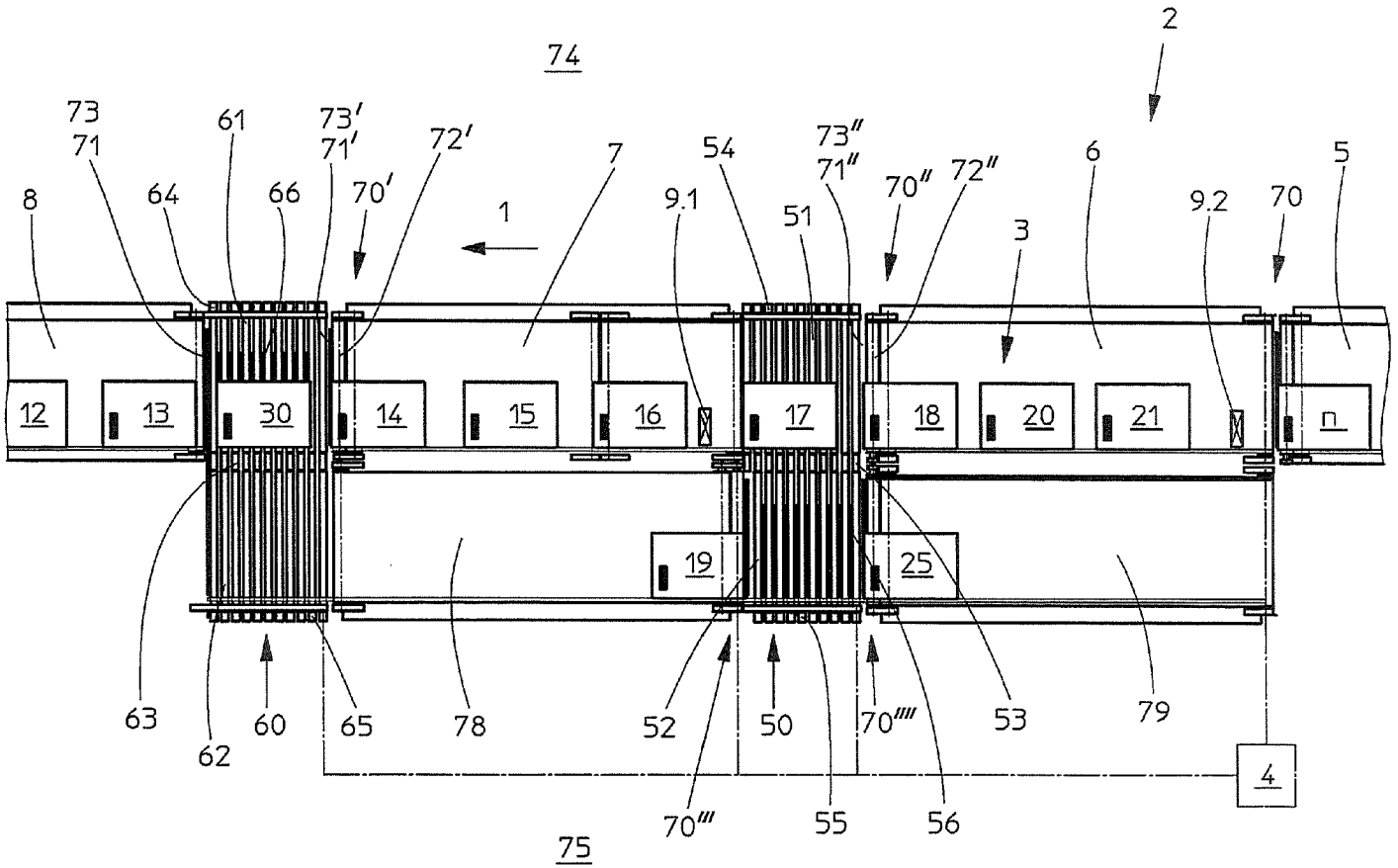
FIG. 4 is a schematic top view of a section of a book production line that contains a book block to be removed, according to a second embodiment of the invention.

As shown in FIGS. 4 to 9, a fully automatic transfer-out and transfer-in of book blocks 30, 25, 19 occurs for the second embodiment. The machine control 4 is connected for this to the conveying section 3, to the first and the second device 60, 50 for the lateral transport of book blocks 19; 30, as well as to the first and the second conveying element 78, 79 (FIG. 4).

In FIG. 4, the book blocks 21, 20, 18, 17, 16, 15, 14, 30, 13 and 12 are arranged successively in the main transporting direction 1 on the conveying section 3, downstream of the scanner 9.2. Unknown book blocks are waiting in front of the scanner 9.2 of which only one book block n is shown for reasons of representation. The book block 19 on the first conveying element 78 is waiting in front of the stop mechanism 70''', in other words between the devices 60, 50 for the lateral transport. The book block 25 is waiting at the stop mechanism 70'''' on the second conveying element 79. With the aid of the trolley 66, the book block 30 can be removed transverse to the main transporting direction 1 from the conveying section 3 of the book production line 2.

Figure 5:
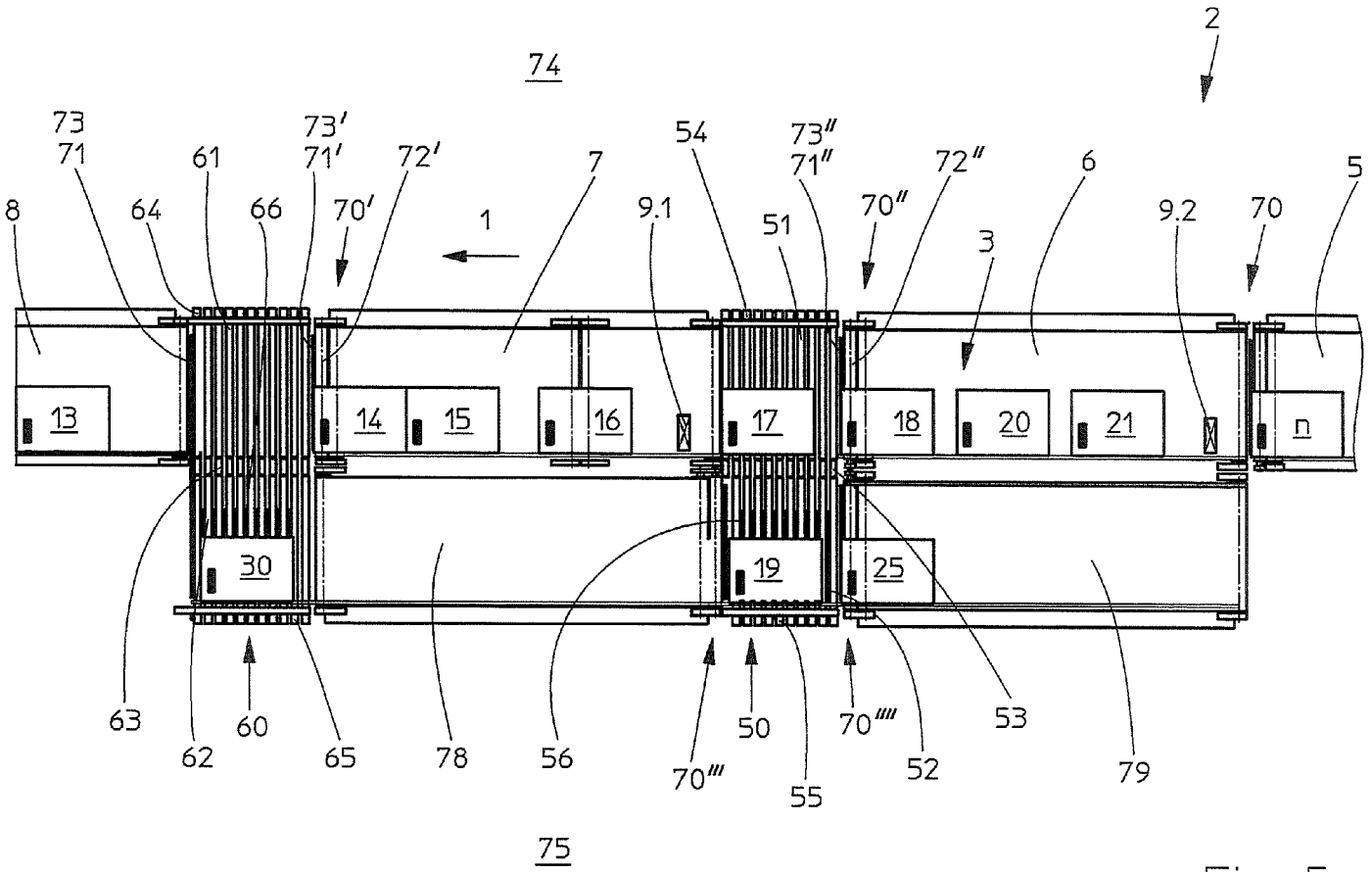
FIG. 5 is a top view, according to FIG. 4, following the removal of the book block and the positioning of a different book block to be supplied.

In FIG. 5, the book block 30 has already been removed from the conveying section 3. The book block 13 meanwhile has been conveyed further along the conveying section 3 in the main transporting direction 1, so that an empty cycle has been generated. The trolley 66 must then be emptied again. The book block 19 is transported in a lateral direction with the aid of the trolley 56 of the device 50.

Figure 6:
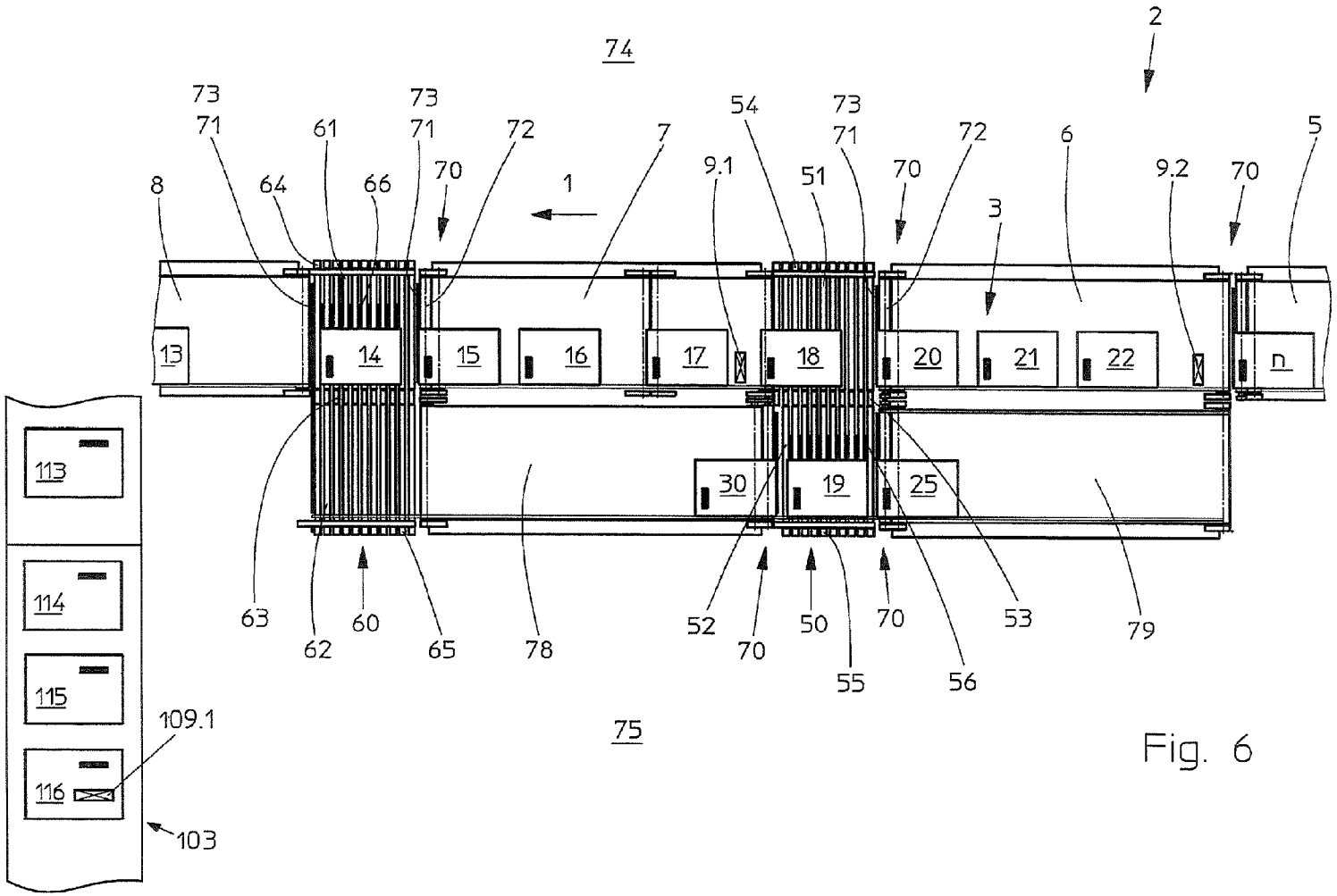
FIG. 6 is a top view, according to FIGS. 4 and 5, following the advancing of a cycle in the main transporting direction and the simultaneous conveying of the removed book block counter to the main transporting direction.

According to FIG. 6, the book blocks positioned on the conveying section 3 have been moved forward by one cycle in the main transporting direction 1 while the removed book block 30 has moved counter to the main transporting direction 1 toward the stop mechanism 70''' of the first conveying element 78. The book block 19 is thus in the position where it can be inserted again between the book blocks 18 and 20 on the conveying section 3. For this, the book block 20 is held back at the stop mechanism 70'' of the second conveying unit 6, to generate a gap between the leading book block 18 and the book block 20.

Figure 7:
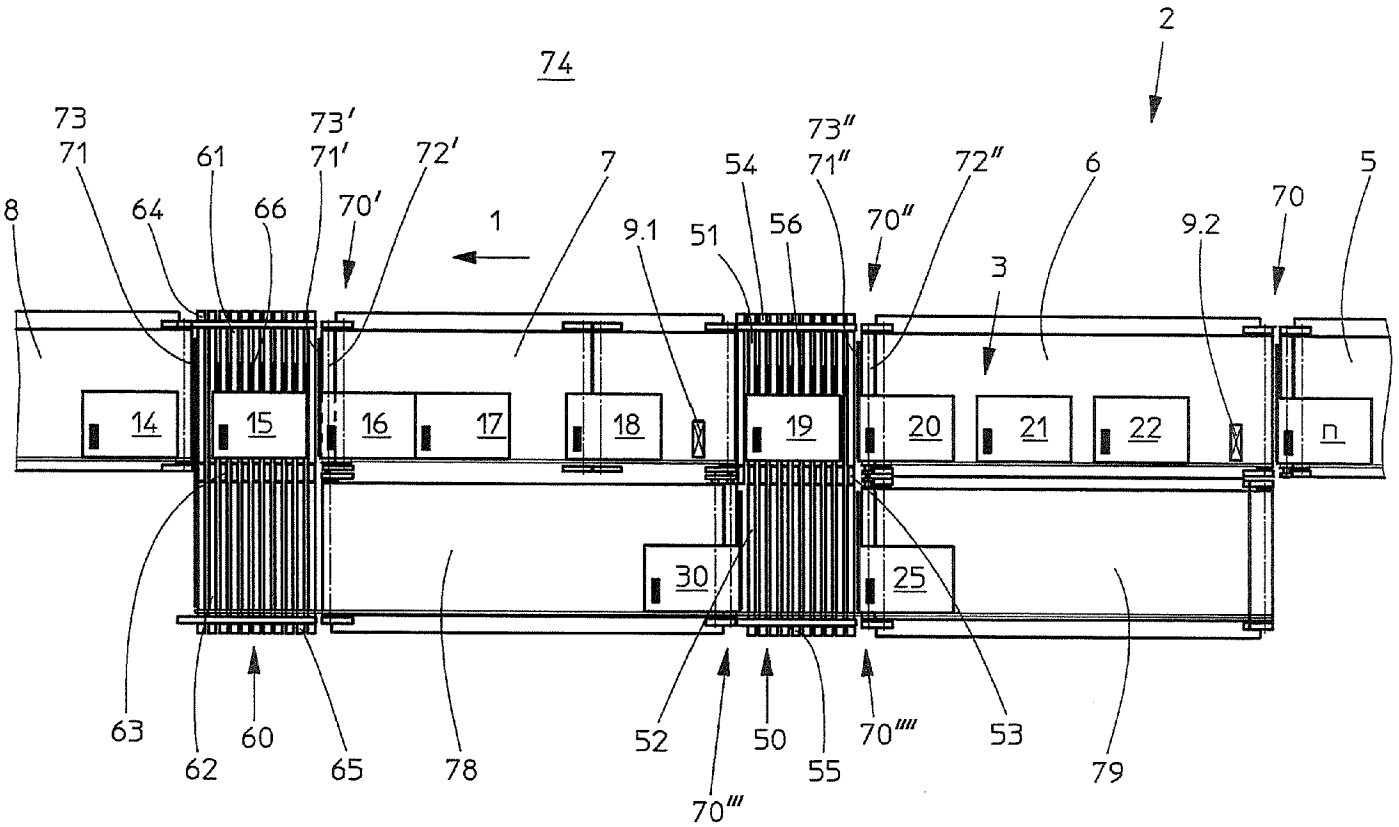
FIG. 7 is a top view, according to FIGS. 4 to 6, following the supplying of the book block.

In FIG. 7, the book block 19 meanwhile has been inserted into the conveying section 3 while the book block 20 is still waiting in front of the stop mechanism 70' of the second conveying unit 6. The additional conveying section 3, including the first conveying unit 7, has meanwhile been advanced by one cycle.

Figure 8:
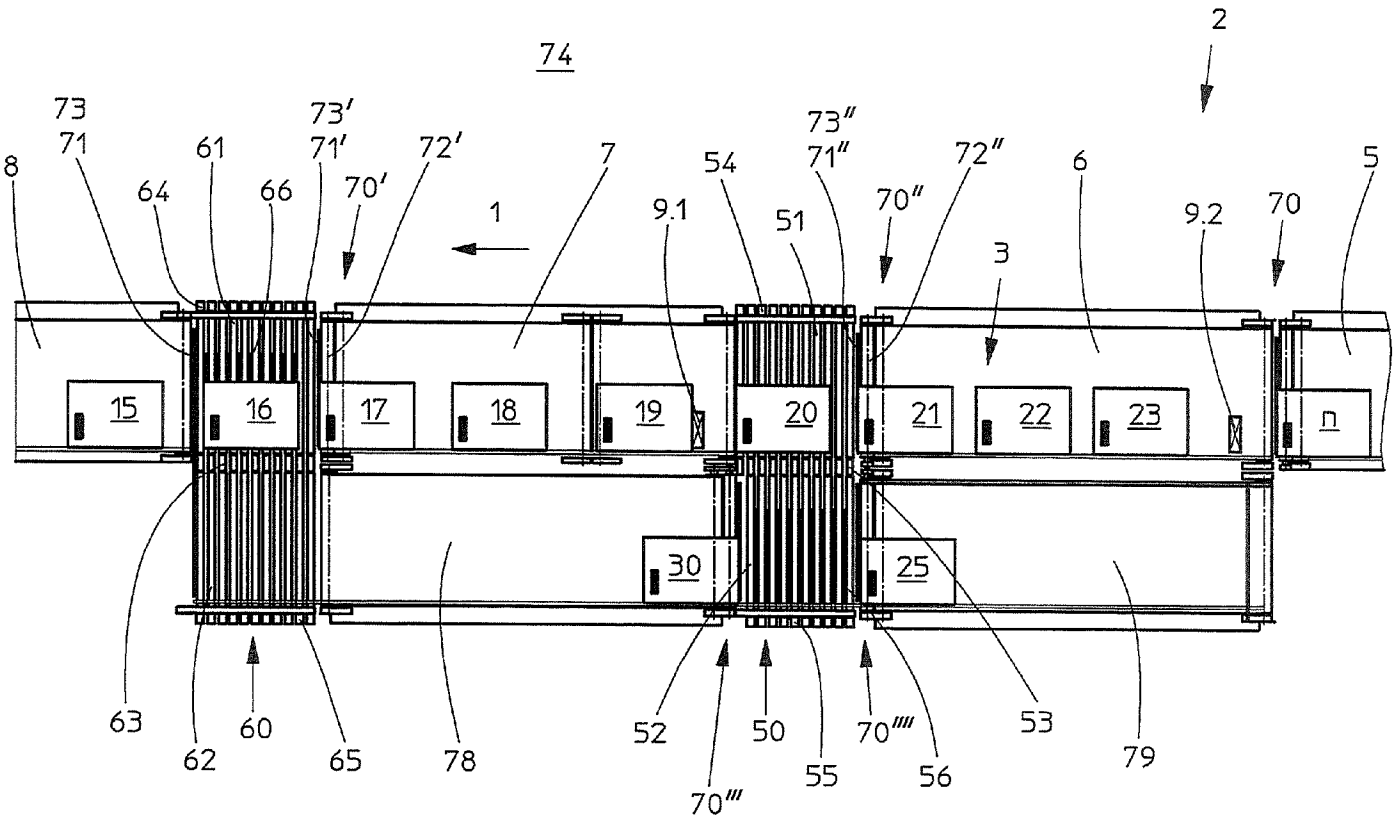
FIG. 8 is a top view, according to FIGS. 4 to 7, wherein the supplied book block has moved forward, after advancing a further cycle in the main transporting direction.

In FIG. 8, the additional conveying section 3 with the conveying belt 8, including the conveying units 6 and 7, has been moved forward by one cycle.

Figure 9:
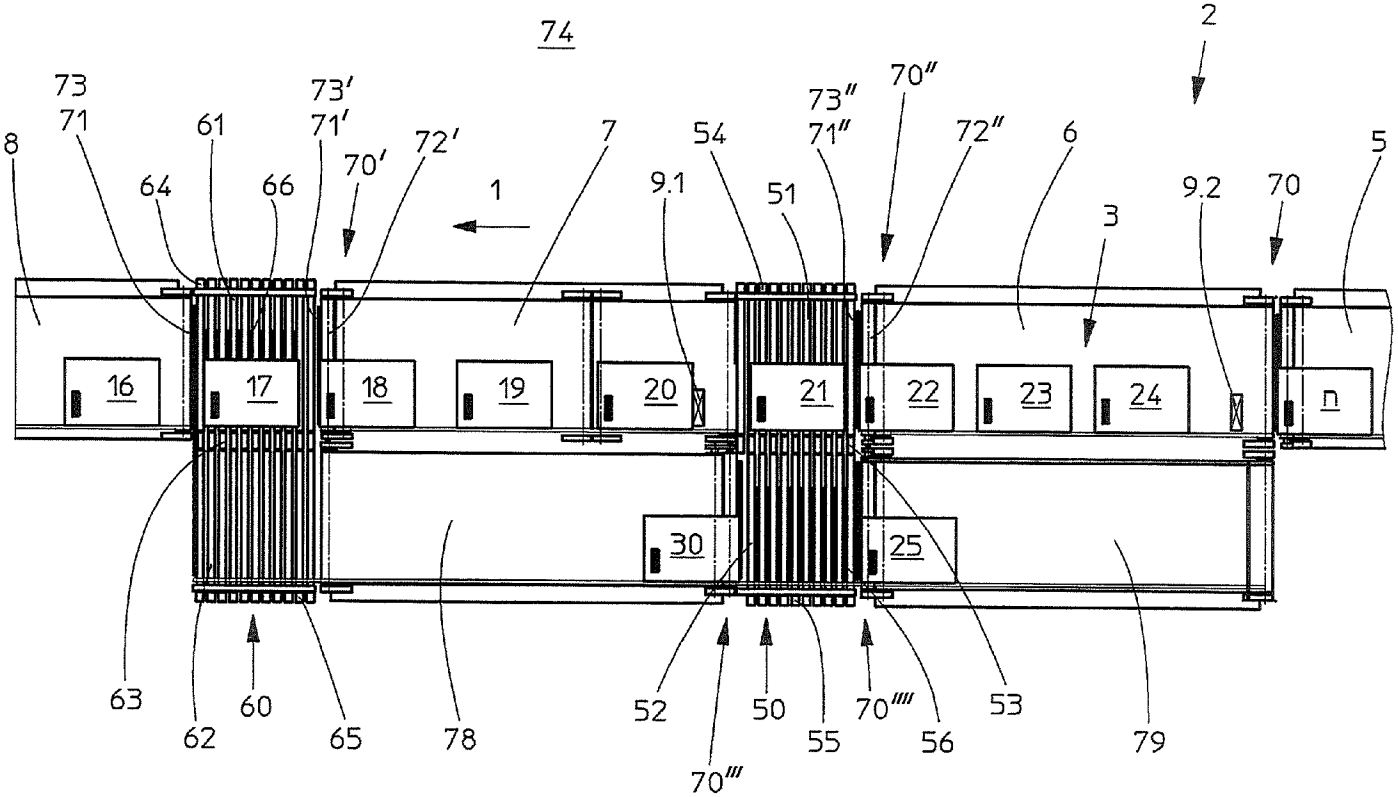
FIG. 9 is a top view, according to FIGS. 4 to 8, following an additional cycle in the main transporting direction.

In FIG. 9, the book block 22 is waiting in front of the stop mechanism 70'' for the second conveying unit 6 and the book block 18 is waiting in front of the stop mechanism 70' for the first conveying unit 7. The book blocks 23, 24 in the meantime have moved past the scanner 9.2 and have been identified, thus establishing the desired sequence for the book blocks. The insertion of the following book block 25 can be prepared. The scanner 9.1 again checks the inserted book blocks and thus ensures an additional functional security for the book production line 2.

According to one embodiment, the lateral transport devices 50, 60, which are aligned coaxial and perpendicular to the main transporting direction 1, are provided with side-by-side arranged rollers 51, 61 on the frame-side and rollers 52, 62 on the operating-side, wherein these are respectively separated by a center bearings 53, 63. The center bearings 53, 63 are connecting elements for the rollers 51, 61, 52, 62 which are attached to a non-depicted frame for the conveying section 3. The frame-side rollers 51, 61 and the operating side rollers 52, 62 can rotate in opposite directions, relative to each other, at the center bearings 53, 63.

At the frame-side ends, the rollers 51, 61 are driven by a frame-side drive 54, 64 and at the operating-side end, the operating-side rollers 52, 62 are driven by an operating-side drive 55, 65.

Arranged below the rollers 51, 52, 61, 62 is a respective trolley 56, 66 which is provided with upward projecting webs that are aligned parallel to the rollers 51, 52, 61, 62. The webs can be moved upwards between the rollers 51, 52, 61, 62, far enough so that they reach a plane above the rollers 51, 52, 61, 62. The trolley 56, 66 can traverse in a direction transverse to the main transporting direction 1 and parallel to the rollers 51, 52, 61, 62.

According to the method for producing books, for example, small book editions, described above, the method may also include supplying the book block 19 to the conveying section 3 with the aid of a second lateral transport device 50 positioned upstream of where the book block 19 is removed from the conveying section 3 and downstream of where the markings on the book blocks are identified at scanner 9.2 (See FIG. 6).

According to one embodiment, a book block 30, 19, may be conveyed between the first lateral transport device 60 and the second lateral transport device 50 in a direction counter to the main transporting direction 1 using a first conveying element 78 that is arranged parallel to the conveying section 3.

According to a further embodiment, at least one book block 30, 19, 25 may be conveyed successively either in a direction counter to the main transporting direction 1 or in the main transporting direction 1 using a second conveying element 79 that is arranged parallel to the conveying section 3.

It will be understood that the above description of the present invention is susceptible to various modifications, changes and adaptations, and that the same are intended to be comprehended within the meaning and range of equivalents of the appended claims.

What is claimed is:

1. A method for the production of books, in particular for producing small book editions, wherein the books include at least one book block and a book case that protects the book block, comprising:

moving a plurality of book blocks successively along a conveying section of a book production line in a main transporting direction;

supplying a stack of book cases to the book production line;

identifying a marking on each of the book blocks and the book cases;

transmitting an identified marking on at least one book case to a machine control of the book production line;

assigning, as a result of the marking on the at least one book case, a dataset stored in the machine control for a sequence of book cases to the supplied stack, wherein the assigning of the dataset is done by one of the machine control or an operator;

determining, based on the identified markings of the book blocks, a sequence in the machine control for book blocks positioned on the conveying section;

comparing the dataset for the sequence of the book cases to the sequence of the book blocks; and at least one of removing or supplying at least one book block from or to the conveying section, based on the comparison, if the sequence of the book blocks deviates from the sequence of the book cases using the machine control.

2. The method according to claim 1, further comprising:

transferring the at least one book block to a first lateral transport device during removal from the conveying section, and conveying the at least one book block on the first lateral transport device in a direction lateral to the main transporting direction.

3. The method according to claim 2, further comprising:

storing the at least one book block which is removed from the conveying section temporarily on the first lateral transport device;

moving the remaining book blocks along the conveying section in the main transporting direction until a following book block, which corresponds to the at least one book block that is removed from the conveying section and corresponds to the sequence of the book cases, has been positioned directly upstream of the first lateral transport device;

holding the following book block in place on the conveying section for a period of time that is long enough so that an empty cycle has been generated on the conveying section creating a gap downstream of the following book block; and inserting the at least one book block that is removed from the conveying section again into the conveying section by conveying it on the first lateral transport device in a direction lateral to the main transporting direction and into the gap for the empty cycle.

4. The method according to claim 2, further comprising supplying the at least one book block to the conveying section with the aid of a second lateral transport device positioned upstream of where the at least one book block is removed from the conveying section and downstream of where the markings on the book blocks are identified.

5. The method according to claim 4, further comprising conveying at least one book block between the first lateral transport device and the second lateral transport device in a direction counter to the main transporting direction using a first conveying element that is arranged parallel to the conveying section.

6. The method according to claim 5, further comprising conveying at least one book block successively either in a direction counter to the main transporting direction or in the main transporting direction using a second conveying element that is arranged parallel to the conveying section.

* * * * *